US009426597B2

(12) United States Patent
Nguyen et al.

(10) Patent No.: US 9,426,597 B2
(45) Date of Patent: Aug. 23, 2016

(54) METHOD AND SYSTEM FOR PLAYING BACK AN AUDIO SIGNAL

(71) Applicant: SONIC EMOTION LABS, Paris (FR)

(72) Inventors: Khoa-Van Nguyen, Paris (FR); Etienne Corteel, Malakoff (FR)

(73) Assignee: SONIC EMOTION LABS, Paris (FR)

( * ) Notice: Subject to any disclaimer, the term of this patent is extended or adjusted under 35 U.S.C. 154(b) by 0 days.

(21) Appl. No.: 14/431,926

(22) PCT Filed: Sep. 25, 2013

(86) PCT No.: PCT/FR2013/052254

§ 371 (c)(1),
(2) Date: Mar. 27, 2015

(87) PCT Pub. No.: WO2014/049267

PCT Pub. Date: Apr. 3, 2014

(65) Prior Publication Data

US 2015/0256958 A1 Sep. 10, 2015

(30) Foreign Application Priority Data

Sep. 27, 2012 (FR) ..... 12 59132

(51) Int. Cl.
*H04S 7/00* (2006.01)
*H04S 3/00* (2006.01)

(52) U.S. Cl.
CPC ... *H04S 7/30* (2013.01); *H04S 3/00* (2013.01); *H04S 2420/13* (2013.01)

(58) Field of Classification Search
None
See application file for complete search history.

(56) References Cited

U.S. PATENT DOCUMENTS

2007/0269063 A1 11/2007 Goodwin et al.
2013/0148812 A1* 6/2013 Corteel ..... H04S 7/30 381/17

FOREIGN PATENT DOCUMENTS

EP 2485504 A1 8/2012
WO 2012/025580 A1 3/2012

OTHER PUBLICATIONS

Bauck et al., "Generalized Transaural Stereo and Applications", Journal Audio Engineering Society, vol. 44, No. 9, Sep. 1996, pp. 683-705.
Berkhout, "A Holographic Approach to Acoustic Control", J. Audio Eng. Soc., vol. 36, No. 12, Dec. 1988, pp. 977-995.
(Continued)

*Primary Examiner* — Brenda Bernardi
(74) *Attorney, Agent, or Firm* — Workman Nydegger

(57) ABSTRACT

The method of playing back a multichannel audio signal via a playback device comprises a plurality of loudspeakers arranged at fixed locations of the device and define a spatial window for sound playback relative to a reference spatial position. The method comprises for at least one sound object extracted from the signal, estimating a diffuse or localized nature of the object and estimating its position relative to the window. The audio signal is played back via the loudspeakers of the device during which playback treatment is applied to each sound object for playing back via at least one loudspeaker of the device, which treatment depends on the diffuse or localized nature of the object and on its position relative to the window, and includes creating at least one virtual source outside the window from loudspeakers of the device when the object is estimated as being diffuse or positioned outside the window.

17 Claims, 3 Drawing Sheets

(56) References Cited

OTHER PUBLICATIONS

Corteel, E. "Equalization in an Extended Area Using Multichannel Inversion and Wave Field Synthesis", Journal of the Audio Engineering Society, vol. 54, No. 12, Dec. 2006, pp. 1140-1161.

International Search Report for corresponding International PCT Application No. PCT/FR2013/052254, Dec. 6, 2013.

Sonicemotion AG, "Method for Efficient Sound Field Control of a Compact Loudspeaker Array," European Application No. 11165720.1, May 11, 2011.

* cited by examiner

METHOD AND SYSTEM FOR PLAYING BACK AN AUDIO SIGNAL

BACKGROUND OF THE INVENTION

The invention relates to the general field of acoustic treatments and sound spatialization.

The invention relates more particularly to playing back a multichannel audio signal via a determined playback device that has a plurality of loudspeakers arranged at fixed locations of the playback device.

The invention applies in preferred but non-limiting manner to a playback device of the acoustic enclosure type, also known as a "baffle structure". In known manner, such an acoustic enclosure is constituted by a single or one-piece structure incorporating the various loudspeakers that are used for playing back the audio signal (the loudspeakers are not separable from the enclosure). An example acoustic enclosure is in particular a soundbar in which the various loudspeakers are incorporated.

The present invention also presents a particular advantage when it is applied to a so-called "compact" acoustic enclosure or more generally to a compact playback device.

In known manner, a compact playback device is a device of dimensions that are small (in particular relative to the dimensions of the room or the hall in which the playback device is to be placed), and in which the loudspeakers are mounted relatively close to one another.

It should be observed that the device may be a one-piece device (such as an acoustic enclosure), or in a variant it may be made up of a plurality of elements, which elements are grouped together so as to form an assembly that is compact, each element being provided with one or more loudspeakers.

By way of illustration, the long dimension of a compact playback device generally does not exceed 2 meters, whereas the spacing between adjacent loudspeakers is less than 50 centimeters.

Various methods exist in the prior art seeking to optimize the playback of a multichannel audio signal via a playback device, while taking account of the physical limits of the playback device, in particular those that result from the distribution of the loudspeakers of the playback device in three-dimensional space.

An example of such a method is described in Document WO 2012/025580 with reference to a plurality of playback devices having a plurality of loudspeakers distributed at various locations in a room so as to cover an extended listening spatial zone (the listening zone models the positions of the listeners).

That method relies on spatially analyzing the multichannel audio signal that it is desired to play back, making it possible to extract and locate the sound objects of the audio signal that are situated inside a sound playback window defined from the physical positions of the loudspeakers of the playback device and of the extended listening zone.

The extracted sound objects are played back inside the sound playback window as a function of their locations within the window by performing first playback treatment. This first playback treatment may for example be wave field synthesis (WFS) treatment, which is itself known.

The other components of the multichannel audio signal are also played back within the sound playback window, in application of second playback treatment (such as for example an intensity panning effect).

Although Document WO 2012/025580 performs spatial analysis and playback of the multichannel audio signal while taking account of the distribution of the loudspeakers of the playback device, in particular by means of the concept of the sound playback window, it is nevertheless restricted to use with playback devices having loudspeakers that are spread throughout the room in which the signal is to be played back and for playback in an extended listening zone.

However Document WO 2012/025580 does not specifically address playing back a multichannel audio signal via a playback device that is compact.

However using a compact playback device presents certain constraints, in particular in terms of the dimensions of the listening zone that can be expected, and of the sound playback window associated with the physical arrangement of the loudspeakers on the playback device, which dimensions are generally smaller than with a playback device made up of a plurality of entities spread throughout the room or the hall in which the device is placed, as envisaged in Document WO 2012/025580.

There therefore exists a need for a method of playing back a multichannel audio signal that is particularly well adapted to playback devices that are compact, and in particular to compact acoustic enclosures, and that makes it possible to optimize the rendering of the audio signal while maintaining intelligibility and clarity for the components of the signal.

OBJECT AND SUMMARY OF THE INVENTION

The invention satisfies this need in particular by proposing a method of playing back a multichannel audio signal via a playback device having a plurality of loudspeakers, the loudspeakers being arranged at fixed locations of the playback device and defining a spatial window for playing back sound relative to a "reference" spatial position. The playback method of the invention is remarkable in that it comprises:

a spatial analysis step of spatially analyzing the multichannel audio signal, this step comprising:

extracting at least one sound object from the signal; and for each extracted sound object, estimating a diffuse or localized nature of this sound object, and estimating a position of this sound object relative to the sound playback spatial window of the playback device; and a playback step of playing back the audio signal via the plurality of loudspeakers of the playback device, during which step, playback treatment is applied to each sound object extracted from the audio signal for playing that object back via at least one loudspeaker of the plurality of loudspeakers of the playback device, this playback treatment depending on the diffuse or localized nature of the sound object and on its position relative to the sound playback spatial window as estimated during the spatial analysis step;

the playback treatment including using the loudspeakers of the playback device to create at least one virtual source outside the playback spatial window of the playback device whenever the sound object is estimated during the spatial analysis step as being diffuse or as being positioned outside the playback spatial window of the playback device.

Correspondingly, the invention also provides a system for playing back a multichannel audio signal via a playback device having a plurality of loudspeakers, said loudspeakers being arranged at fixed locations of the playback device and defining a spatial window for playing back sound relative to a reference position, said playback system comprising:

spatial analysis means for spatially analyzing the multichannel audio signal, these means comprising:

extraction means for extracting at least one sound object from the signal; and estimation means for estimating a diffuse or localized nature of this sound object, and estimating a position of this sound object relative to the sound playback spatial window of the playback device; and playback means for playing back the audio signal via the plurality of loudspeakers of the playback device, which means are suitable for applying playback treatment to each sound object extracted from the audio signal for playing that object back via at least one loudspeaker of the plurality of loudspeakers of the playback device, this playback treatment depending on the diffuse or localized nature of the sound object and on its position relative to the sound playback spatial window as estimated during the spatial analysis step;

the playback treatment including using the loudspeakers of the playback device to create at least one virtual source outside the playback spatial window of the playback device whenever the sound object is estimated by the spatial analysis means as being diffuse or as being positioned outside the playback spatial window of the playback device.

The term step (or means) for "playing back via loudspeakers" is used herein to mean a step (or means) consisting in generating signals and in delivering them to drive the loudspeakers of the playback device. These signals are then diffused (i.e. emitted) by the loudspeakers of the playback device so as to play back the multichannel audio signal.

Furthermore, the term "reference spatial position" is used herein to cover equally well a point in space characterizing the position of a target listener of the audio signal, or a more extended area of space that may accommodate one or more listeners. For a compact playback device, attention is given more particularly to a reference spatial position that is a point even if the playback method of the invention makes it possible to reach a listening zone that is particularly extensive.

The invention thus proposes using spatial analysis of the multichannel audio signal for playing back seeking to separate the sound objects making up the audio signal as a function firstly of their diffuse or localized nature in three-dimensional space (i.e. their nature of being discrete, as generated by a locatable source), and secondly their positions relative to the sound playback window defined by the reference spatial position and by the physical locations of the loudspeakers on (or in) the playback device relative to the reference spatial position.

In accordance with the invention, advantage is taken of this separation of sound objects by applying playback treatments to the extracted objects that take account of their localized or diffuse natures, and also of the positions of the sources from which these objects originate inside or outside the sound playback window. In other words, in the invention, the playback treatments that are applied to the sound objects of the multichannel signal to be played back are associated directly with the spatial characteristics of these objects as extracted during the spatial analysis of the multichannel signal.

More precisely, the sound objects that are identified during the spatial analysis step as being diffuse or as being positioned outside the playback spatial window of the playback device, are advantageously played back outside the window via the loudspeakers of the playback device, by performing playback treatments that involve creating virtual sources outside the window.

In contrast, when an extracted sound object is estimated as being localized and positioned inside the sound playback spatial window of the playback device, the playback treatment applied to the sound object during the playback step is preferably suitable for playing back the sound object inside the sound playback spatial window of the playback device at the location of the source from which the sound object originates.

This playback within the sound playback spatial window may be performed directly, by diffusing the sound objects via the loudspeakers of the playback device without having recourse to complex spatial filtering methods. For example, the object is diffused without change via one or more loudspeakers, or is diffused merely by applying an intensity panning effect. Such techniques are themselves known and relatively simple to implement.

In a variant, the playback treatment inside the playback spatial window may involve creating one or more virtual sources using the loudspeakers of the playback device and located inside the sound playback spatial window of the playback device. This may in particular involve treatment of the WFS type or of a derivative thereof.

The directions or the positions of the virtual sources, and, where appropriate, their amplitudes, are then determined from the estimated positions of the originating sources of the localized sound objects extracted from the multichannel signal, and from their contributions to the multichannel signal (e.g. contributions in terms of sound level).

Such playback treatment based on creating virtual sources makes it possible to have better control over the directivity of the sound objects as played back in this way.

Acting during the playback step to apply the above-mentioned playback treatments that are selected as a function of the characteristics of the sound objects as determined during the spatial analysis step makes it possible to move objects that are diffuse or that come from outside the playback window away from objects that are located inside the window (where such objects typically include voice or dialog).

This serves to increase the apparent width of the sound scene perceived by the listener (or listeners) situated at the reference spatial position relative to the nominal sound playback window offered by the playback device, which window is particularly limited with a playback device that is compact. In other words, in spite of the playback device being compact, the listener has the perception of being immersed in the sound scene (perception of being surrounded within the sound scene).

Furthermore, in addition to this enlargement of the sound scene as perceived by the listener, greater contrast is established between the sound objects that are localized and situated inside the sound playback window compared with the objects that are diffuse or that are localized outside the window. The objects that are localized and determined as being positioned inside the playback window are thus played back with greater accuracy and better directivity. The contrast that is established by the invention consequently enhances the clarity and the intelligibility of these sound objects for the listener in the reference position.

In other words, the invention takes advantage of a phenomenon that is well known in psycho-acoustics under the name "cocktail-party effect", which represents the capacity of the human hearing system to select a sound source in a noisy environment and to process sounds even if they are not the subject of human attention.

By associating the characteristics of the sound objects extracted from the audio signal during the spatial analysis with the playback treatments to be applied during the playback step for playing these objects back via the loudspeakers of the playback device, the invention thus enables the multichannel audio signal to be played back with very good quality, even on a playback device that is compact, while preserving the accuracy and the clarity of localized objects of the sound signal coming from inside the playback window. The invention may be applied to any multichannel signal format, such as for example to a signal in one of the following formats: stereo, 5.1, 7.1, 10.2, higher order ambisonics (HOA), etc.

It should be observed that the treatment performed in general manner by the invention does not in itself seek to modify the characteristics of the sound scene of the multichannel audio signal, but rather enhances the intelligibility of localized sound objects inside the sound playback window, and also enables the listener to be immersed in the sound scene.

In a variant implementation, the spatial analysis step further comprises estimating the position of the sound object relative to the center of the sound playback spatial window of the playback device.

As a result, it is possible during the playback step to apply distinct playback treatments depending on whether the sound object is at the center of the sound playback spatial window or is at a position that is distinct from the center but still inside the sound playback spatial window, thereby better isolating the center from other sound objects. This obtains better contrast and better intelligibility for the center compared with other objects situated inside the window. It may be observed that the center is often associated with sound objects such as voice or dialog.

As mentioned above, the invention has a preferred but non-limiting application when the playback device is an acoustic enclosure having a plurality of loudspeakers arranged therein. By way of example, such an acoustic enclosure is a soundbar having a plurality of loudspeakers.

In a particular implementation of the invention, the spatial analysis step comprises decomposing the received audio signal into a plurality of frequency sub-bands, with said at least one sound object being extracted on at least one frequency sub-band.

This decomposition into frequency sub-bands (e.g. in octave bands, in one-third octave bands, or in hearing bands) facilitates and improves the extraction of sound objects constituting the audio signal. The spatial analysis of the audio signal is performed in each frequency sub-band: this makes it possible to achieve better isolation of the sound objects making up the multichannel audio signal. In particular, it is possible to isolate a plurality of sound objects in the multichannel audio signal, e.g. one per frequency sub-band.

In a variant implementation of the invention, the diffuse or localized nature of the extracted sound object is estimated from at least one correlation evaluated between two distinct channels of the multichannel audio signal.

Furthermore, the position of the extracted sound object relative to the sound playback spatial window may be estimated from at least one difference of level as evaluated between two distinct channels of the multichannel audio channel.

Consequently, it is possible to determine the characteristics associated with each sound object extracted from the multichannel audio signal (i.e. diffuse or localized nature, position relative to the playback window) in a manner that is very simple, by calculating correlations and level differences between the signals distributed over the various channels of the multichannel signal.

In another variant implementation, the spatial analysis step comprises determining a Gerzon vector representative of the multichannel audio signal.

In known manner to the person skilled in the art, the Gerzon vector of a multichannel audio signal is derived from the respective contributions (direction and intensity or energy) of the various channels of the multichannel signal to the sound scene perceived by the listener at the reference position. How to determine such a vector for a multichannel audio signal is described in Document US 2007/0269063, for example.

The Gerzon vector of a multichannel audio signal represents the spatial localization of the multichannel audio signal as perceived by the listener in the reference position. Determining this Gerzon vector makes it possible to avoid calculating correlations between the various channels of the multichannel signal in order to determine the diffuse or localized nature of the sound objects extracted from the signal.

In another variant implementation, the spatial analysis step comprises spatially decomposing the multichannel signal into spherical harmonics.

Such spatial decomposition is known to the person skilled in the art and is described in Document WO 2012/025580, for example. It enables very accurate spatial analysis to be performed of the multichannel audio signal and of the sound objects making it up. Thus, in particular, a plurality of sound objects can be determined for a single frequency sub-band.

Various treatments may be envisaged in the ambit of the invention for playing back sound objects extracted during the spatial analysis, inside or outside the playback spatial window.

Thus, in a first variant implementation of the invention, in which the plurality of loudspeakers of the playback device comprises a central loudspeaker and lateral loudspeakers, and when the extracted sound object is estimated during the spatial analysis step as being diffuse or as being positioned outside the playback spatial window of the playback device, the playback treatment applied to the sound object uses a transaural technique for playing back the sound object via the lateral loudspeakers of the playback device.

This first variant implementation has a preferred application for a playback device having a small number of loudspeakers, e.g. one central loudspeaker and two lateral loudspeakers.

In a second variant implementation of the invention, in which the plurality of loudspeakers of the playback device comprises a central loudspeaker and lateral loudspeakers, and when an extracted sound object is estimated during the spatial analysis step as being localized and as being positioned at the center of the playback spatial window of the playback device, the sound object is diffused during the playback step by playback treatment via the central loudspeaker of the playback device.

In other words, a sound object that is centered relative to the reference spatial position is attached to the center of the playback device so as to optimize its intelligibility. It is preferably played back directly (i.e. without spatial filtering) via the central loudspeaker of the playback device, so as to benefit from the natural directivity properties of the central loudspeaker.

Other techniques for playing back a sound object that is centered relative to the reference spatial position could naturally be envisaged for maximizing its intelligibility. Thus, for example, it is possible to envisage forming a beam (a technique known as "beamforming") that is directed towards the reference spatial position or to envisage using a transaural technique.

In a third variant implementation, when an extracted sound object is estimated during the spatial analysis step as being localized and positioned inside the playback spatial window of the playback device at a position that is distinct from the center of the window, the playback treatment applied during the playback step diffuses this sound object via the loudspeakers of the playback device while using an intensity panning effect.

Thus, sound objects that are localized and positioned inside the acoustic window are also attached to the playback device and played back directly (i.e. without spatial filtering) inside the playback window by means of the intensity panning effect applied to the loudspeakers. This intensity panning effect applied to all of the loudspeakers of the playback device makes it possible to better distinguish sound objects that are localized and positioned inside the acoustic window from sound objects that are situated at the center of the window.

Nevertheless, the invention is not limited to applying the above-specified playback treatments; it is also possible to have recourse to playback treatments that are more complex, in particular making use of spatial filtering of the sound objects via the loudspeakers of the playback device.

Thus, by way of example, when the extracted sound object is estimated during the spatial analysis step as being positioned outside the playback spatial window of the playback device, creating at least one virtual source outside the playback spatial window of the playback device may involve forming at least one beam directed to the outside of the playback spatial window ("beamforming").

In similar manner, when an extracted sound object is estimated during the spatial analysis step as being localized and positioned inside the playback spatial window of the playback device, the playback treatment applied to the sound object during the playback step comprises forming a beam that may be directed towards the reference spatial position.

In general, creating virtual sources makes it possible to obtain better control and better accuracy in the sound playback of an audio signal than when using "direct" sound playback (i.e. without spatial filtering) via the loudspeakers of the playback device, since that is limited to the sole capacity of the loudspeakers of the playback device. Creating virtual sources makes it possible to have better control over the directivity of the sound sources as reconstituted.

Furthermore, using beamforming to create a virtual source inside or outside the playback window makes it easy to control the width of the virtual source as created in this way. Beamforming is particularly well adapted to playing back signals via dense loudspeaker networks (e.g. a playback device having six or more loudspeakers), where greater accuracy is available for creating the virtual sources because of the existence of a larger number of degrees of freedom (associated with the presence of a larger number of loudspeakers).

Furthermore, when playing back sound objects, it is possible, when using beamforming techniques, to interact more easily with the dimensions of the room or the hall in which the playback device is placed. Thus, by way of example, when the beam is directed to the outside of the playback window, it is possible, by acting on the width of the beam, to enlarge the area that is reflected by the walls of the room, and thereby create for the listener a better sensation of being surrounded by the sound scene.

In a particular implementation, the various steps of the playback method are determined by computer program instructions.

Consequently, the invention also provides a program on a data medium, the program being suitable for being performed in a playback system or more generally in a computer, the program including instructions adapted to perform steps of a playback method as described above.

The program may use any programming language, and may be in the form of source code, object code, or code intermediate between source code and object code, such as in a partially complied form, or in any other desirable form.

The invention also provides a data medium that is readable by a computer or by a microprocessor, and that includes instructions of a program as mentioned above.

The data medium may be any entity or device capable of storing the program. For example, the medium may comprise storage means such as a read-only memory (ROM), e.g. a compact disk (CD) ROM or a microelectronic circuit ROM, or indeed magnetic recording means, e.g. a floppy disk or a hard disk.

Furthermore, the data medium may be a transmissible medium such as an electrical or optical signal, suitable for being conveyed via an electrical or optical cable, by radio, or by other means. The program of the invention may in particular be downloaded from an Internet type network.

Alternatively, the data medium may be an integrated circuit in which the program is incorporated, the circuit being adapted to execute or to be used in the execution of the method in question.

In another aspect, the invention also provides an acoustic enclosure including a playback system in accordance with the invention.

In other embodiments or implementations, it is also possible to envisage that the playback method, the playback system, and the acoustic enclosure of the invention present in combination some or all of the above-specified characteristics.

BRIEF DESCRIPTION OF THE DRAWINGS

Other characteristics and advantages of the present invention appear from the following description made with reference to the accompanying drawings, which show implementations having no limiting character.

In the figures.

DETAILED DESCRIPTION OF THE INVENTION

Figure 1:
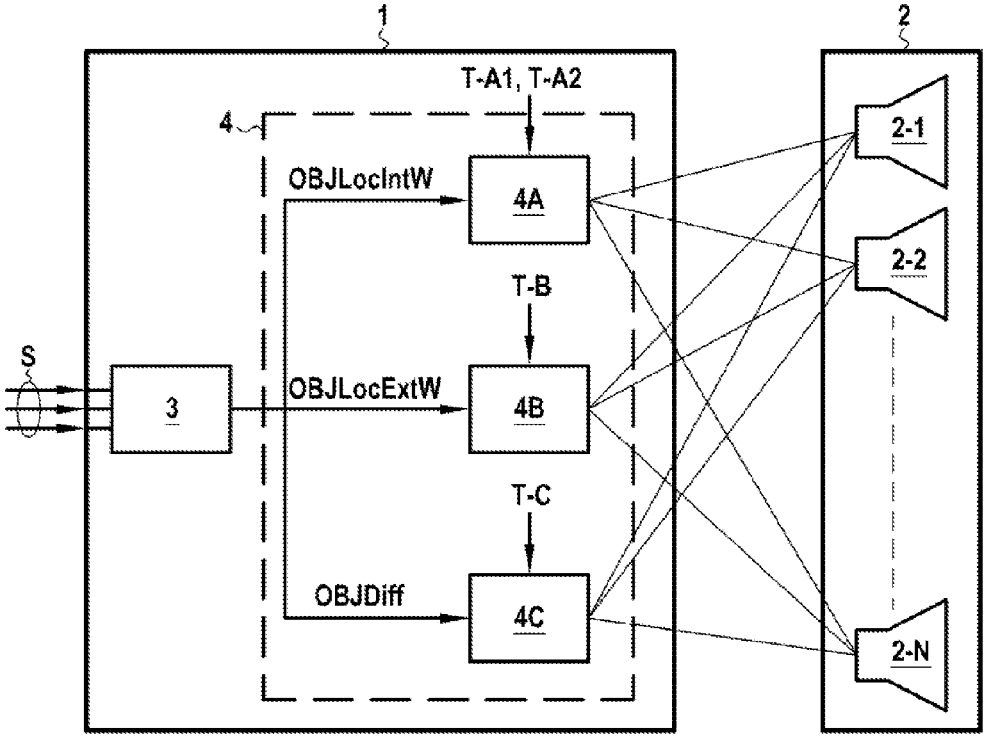
FIG. 1 shows a playback system in accordance with the invention, in a particular embodiment.

FIG. 1 shows, in its environment, a playback system 1 for playing back a multichannel audio signal S on a playback device 2 constituting a particular embodiment of the invention.

The playback device 2 is provided with a plurality of loudspeakers 2-1, 2-2, . . . , 2-N (N>1). In the example shown in FIG. 1, it comprises a compact playback device.

More precisely, the playback device 2 in this example is a compact acoustic enclosure, in other words a single-piece structure or single closed box, incorporating the set of loudspeakers 2-1, 2-2, . . . , 2-N.

By way of example, the playback device 2 is a soundbar mounted horizontally, of length not exceeding one or two meters, having the loudspeakers 2-1, 2-2, . . . , 2-N arranged therein (or thereon) at locations that are fixed and close to one another (there being less than 50 centimeters (cm) from one to the next).

Nevertheless, these assumptions are not limiting, and the invention applies equally well to other types of playback device. Thus, the invention also applies to a modular compact playback device constituted by a plurality of separate elements, each incorporating one or more loudspeakers.

It should be observed that the concept of a compact playback device is known to the person skilled in the art: a compact playback device designates a device of small dimensions, in particular compared with the dimensions of the room or the hall in which it is envisaged to play back the audio signal by means of the device, with the loudspeakers that are mounted on or in the device being relatively close to one another. By way of illustration, the longest dimension of a compact playback device generally does not exceed two meters, and the loudspeakers are mounted on the playback device at a spacing of less than 50 cm.

The physical locations of the loudspeakers 2-1, 2-2, . . . , 2-N act in known manner to define a spatial window W for sound playback relative to a reference position, written Pref, that is located in front of the playback device 2 (in particular relative to the orientation of some or all of the loudspeakers and to the diffusion of sounds), and that models the position of a listener in the space used as a reference for optimizing the playback of the audio signal S.

The selection properly speaking of the reference position Pref depends on several factors known to the person skilled in the art, and is not described herein. For a compact playback device, this reference position Pref is generally selected to be a point.

Figure 2:
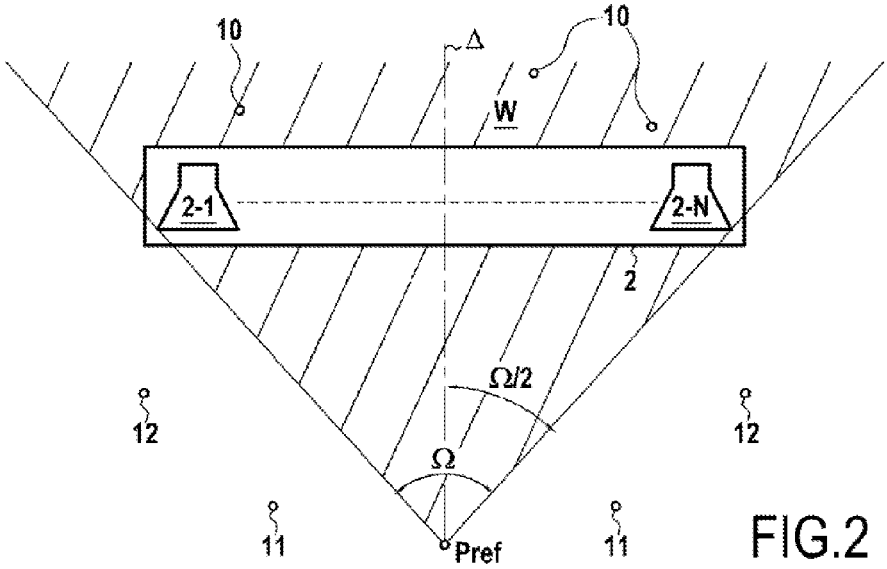
FIGS. 2, 3A, and 3B show examples of sound playback spatial windows for various playback devices and reference positions.

FIG. 2 shows the sound playback spatial window W that is defined by the loudspeakers 2-1, 2-2, . . . , 2-N of the playback device 2 together with the reference position Pref.

In known manner, the physical locations of the loudspeakers 2-1, 2-2, . . . , 2-N on the playback device 2 (and more precisely of the two loudspeakers 2-1 and 2-N situated at the ends of the playback device 2), in association with the reference position Pref, define an aperture angle Ω for sound playback.

The subspace defined by this aperture angle Ω corresponds to the sound playback spatial window W associated with the playback device 2 and with the reference position Pref.

It should be observed that:

the window W depends on the reference position Pref. In the example of FIG. 2, the position Pref is aligned relative to the center of the playback device 2, such that the spatial window W is defined by an excursion angle Ω/2 relative to the axis Δ that connects the center of the playback device 2 to the reference position Pref; and only the physical locations of the loudspeakers of the playback device 2 (and in particular of the loudspeakers situated at the ends of the playback device 2) relative to the position Pref are taken into account in the concept of a sound playback spatial window. No account is taken of the powers of the loudspeakers of the playback device 2, or of other characteristics that might influence their ability to play back an audio signal.

Figure 3A:
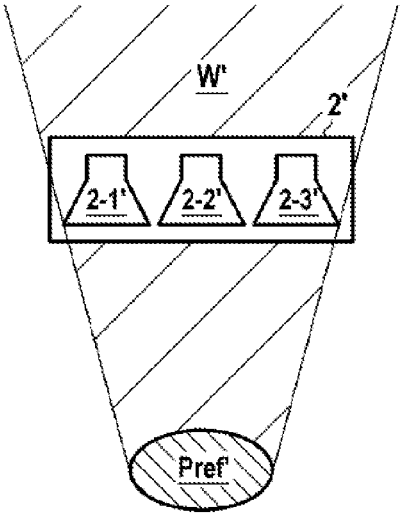
Figure 3B:
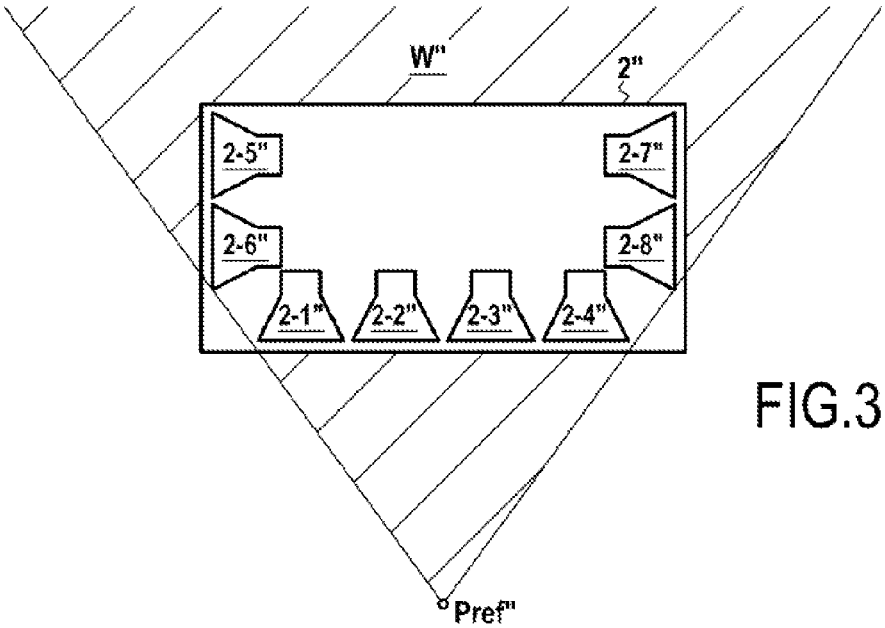

As examples, FIGS. 3A and 3B show respectively:

a sound playback window W' of a soundbar type playback device 2' that is mounted horizontally, the device having three loudspeakers 2-1', 2-2', 2-3' relative to an extended reference spatial position Pref; and a sound playback spatial window W" of a playback device 2" having eight loudspeakers 2-1", 2-2", . . . , 2-8" relative to a point reference spatial position Pref', the loudspeakers 2-1" to 2-4" being front speakers, while the loudspeakers 2-5", 2-6", and 2-7", 2-8" are arranged on opposite sides of the playback device 2".

As mentioned above, the invention proposes treating a multichannel audio signal in two stages: in a first stage, the multichannel audio signal for playing back is analyzed spatially; then the spatial characteristics of the signal resulting from this spatial analysis are used to optimize the playback of the signal on the playback device 2.

Thus, the playback system 1 of the invention comprises:

spatial analysis means 3 for analyzing the multichannel audio signal S, which means comprise in particular means for extracting at least one sound object from the signal, and means for estimating, for each extracted sound object, a diffuse or localized nature of the sound object, and a position of the sound object relative to the sound playback spatial window W of the playback device 2 (the extraction of sound objects and the estimation of their characteristics are generally performed jointly); and playback means 4 for playing back the audio signal S over the plurality of loudspeakers 2-1, . . . , 2-N of the playback device 2, which means are suitable for applying playback treatment to each sound object extracted from the audio signal, which processing is applied to at least one loudspeaker of the plurality of loudspeakers 2-1, . . . , 2-N of the playback device, this playback treatment depending on the diffused or localized nature of the sound object and on its position relative to the sound playback spatial window as estimated during the spatial analysis step.

More precisely, in the presently-described example, the playback means 4 are suitable for applying playback treatments T-A1, T-A2, T-B, and T-C to the sound objects extracted from the signal S as a function of the characteristics as determined by the spatial analysis means 3. Nevertheless, there is no limitation on the number of different treatments that might be applied by the playback system 1.

It should be observed that although the treatments T-A1, T-A2, T-B, and T-C depend on the characteristics of the extracted sound objects, the treatments may be of the same kind (i.e. based on the same techniques, such as for example a WFS or beamforming technique). Nevertheless, they are adapted to the spatial characteristics of the sound objects to which they are applied and in this sense they differ from one another. Thus, by way of example, they do not diffuse the signals over the same loudspeakers, they do not envisage creating virtual sources in the same sub-spaces (or having characteristics that are similar in terms of position/direction and/or amplitude), it being possible for the beams that are created to have different dimensions (e.g. different widths), etc.

Thus, in this example, the playback means 4 comprise:

treatment means 4A adapted to apply one or more playback treatments to the sound objects of the audio signal S that are determined as being localized and inside the sound playback window W. In the example shown in FIG. 1, the treatment means 4A are suitable for applying a treatment T-A1 to the sound objects generated by sources placed at the center of the window W, and a treatment T-A2 to the sound objects placed within the window W at a position other than at the center;

treatment means 4B suitable for applying a treatment T-B to the sound objects of the audio signal S that are determined as being diffuse; and treatment means 4C suitable for applying a treatment T-C to the sound objects of the audio signal S that are determined as being localized and lying outside the sound playback window W.

The playback treatments T-A1, T-A2, T-B, and T-C are described in greater detail below and they are illustrated by examples.

In the presently-described embodiment, the spatial analysis means 3 and the audio signal playback means 4 are software means.

Figure 4:
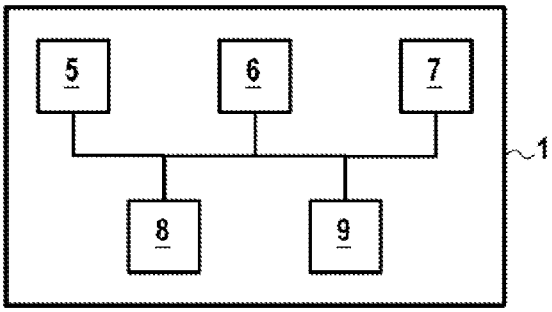
FIG. 4 is a diagram showing hardware architecture of the FIG. 1 playback system.

More precisely, in the presently-described embodiment, the playback system 1 has the hardware architecture of a computer, as shown in FIG. 4.

It comprises in particular a processor (or microprocessor) 5, a random access memory (RAM) 6, a ROM 7, a non-volatile flash memory 8, and communications means 9 suitable for sending and receiving signals.

Thus, the communications means 9 comprise firstly a wired or wireless interface with the loudspeakers 2-1, . . . , 2-N of the playback device 2, and also means for receiving a multichannel audio signal, such as the signal S, for example. These means are known to the person skilled in the art and they are not described in greater detail herein.

The ROM 7 of the playback system 1 constitutes a data medium in accordance with the invention that is readable by the (micro)processor 5, and that stores a computer program in accordance with the invention, including instructions for executing steps of a playback method described below with reference to FIG. 5.

It should be observed that no limitation is put on the particular nature of the playback system 1. Thus, in particular, the playback system 1 may be in the form of a computer, or in a variant in the form of an electronic chip or integrated circuit, in which the computer program including the instructions for executing the playback method of the invention is incorporated.

Furthermore, the playback system 1 may be an entity that is distinct from the playback device 2, or on the contrary it may be incorporated inside the playback device 2.

Figure 5:
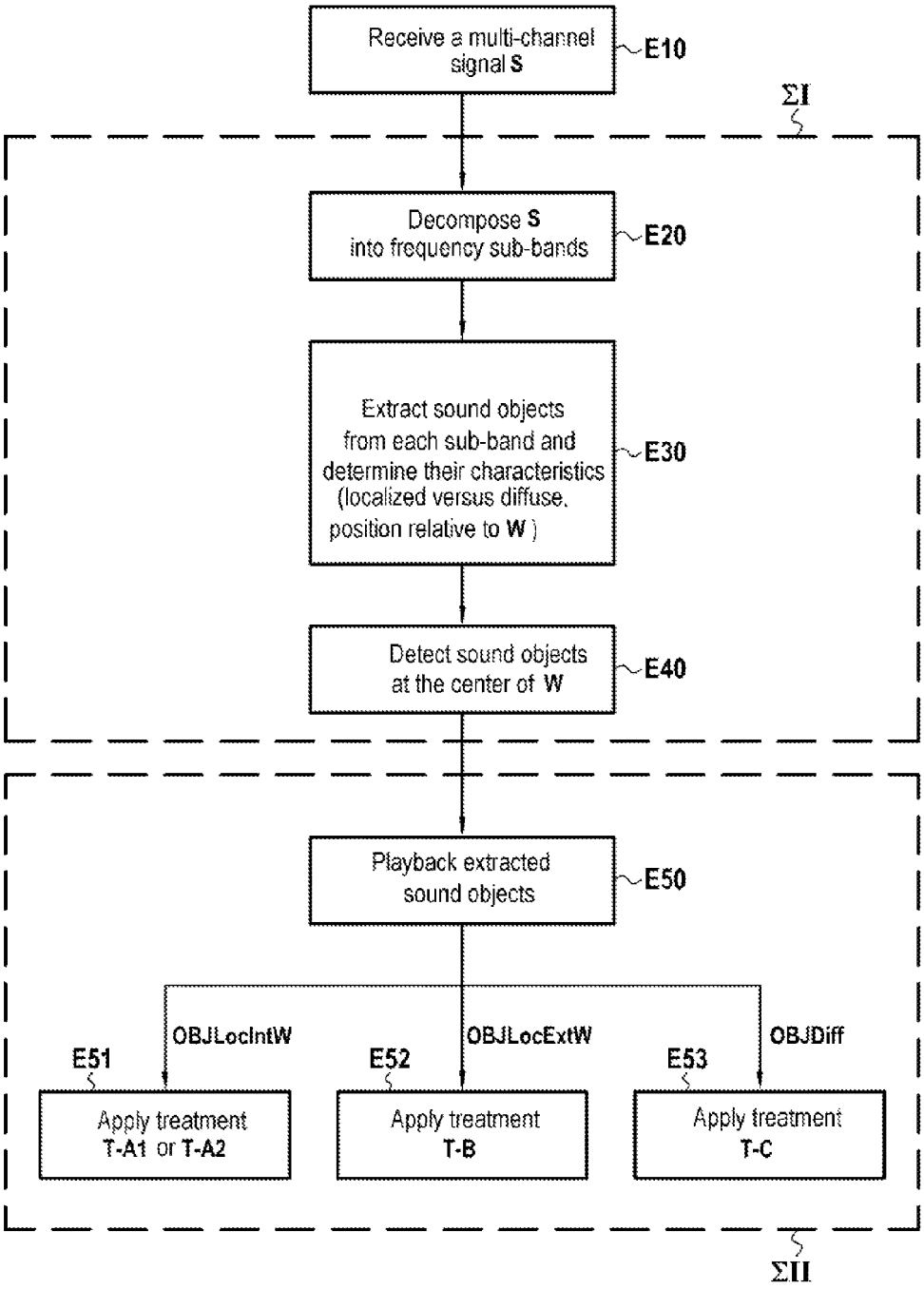
FIG. 5 shows the main steps of a playback method of the invention, as they are performed in a particular implementation by the playback system of FIG. 1.

With reference to FIG. 5, there follows a description of the various steps of the playback method of the invention in a particular implementation in which it is performed by the playback system 1 for playing back the multichannel audio signal S on the loudspeakers 2-1, . . . , 2-N of the playback device 2.

It is assumed that the multichannel audio signal S is delivered to the playback system 1 via its communications means 9. The format and the structure of such an audio signal are known to the person skilled in the art and are not described herein.

On receiving the signal S (step E10), the playback system 1 initiates a first phase ΣI of spatially analyzing the signal S, which phase is performed with the help of its spatial analysis means 3.

More precisely, in the presently-described implementation, during this first phase ΣI, the playback system 1 decomposes the multichannel signal S into a plurality K of frequency sub-bands written BW1, . . . , BWK (step E20), each frequency sub-band BWi, i=1, . . . , K incorporating the various channels making up the signal S. In other words, the signal written Si that results from decomposing the signal S and that is associated with the frequency sub-band BWi, is itself a multichannel signal.

No limitation is associated with the width of each sub-band: for example, it is possible to envisage decomposing in octave bands, in one-third octave bands, or indeed in hearing bands (i.e. bands adapted to hearing) as a function in particular of a compromise between complexity and accuracy.

The signal S is decomposed into frequency sub-bands by means of a Fourier transform applied to the signal S, and this does not present any particular difficulty for the person skilled in the art.

After decomposing into sub-bands, the playback system 1 analyses the signals Si, i=1, . . . , K associated with each frequency sub-band BWi, i=1, . . . , K.

During this analysis, for each frequency sub-band BWi, it extracts the sound objects contained in the signal Si (i.e. in equivalent manner the sounds or sound elements present in the signal Si), and for each extracted sound object, it estimates (step E30):

whether it is a localized object (the object is created by a source that is localized and identifiable in three-dimensional space) or a diffuse object (i.e. the object does not come from a source that can be localized, but appears to come from all around the listener); and when the object is localized, its position (i.e. the position of the source from which the object originates) relative to the sound playback spatial window W.

In the presently-described embodiment, the amplitudes of the extracted sound objects are contained directly in the signals Si, and they correspond to the respective levels of the frequency sub-bands.

The sound objects are extracted, and the above-mentioned characteristics of each object (localized/diffuse, position relative to the spatial window W) are estimated in joint manner by the spatial analysis means 3.

Various techniques may be used for this purpose by the means 3 of the playback system 1.

Thus, in a first variant of the invention, the spatial analysis means 3 of the playback system 1 make use of time analysis of the multichannel signal Si.

During this time analysis, the playback system 1 acts for each pair of distinct channels of the multichannel signal Si to evaluate the normalized correlation between those channels (i.e. the signals representative of the channels), as defined by the following equation:

$$R_{x,y}(p) = \begin{cases} \frac{1}{M} \sum_{m=0}^{M-p-1} x(m+p)y^*(m) & \text{for } p \geq 0 \\ R^*_{x,y}(-p) & \text{for } p < 0 \end{cases}$$

where x and y respectively designate two distinct channels of the multichannel signal Si, where [.]* designates the complex conjugate operator, and where M is a constant defining the number of signal samples over which correlation is evaluated.

Alternatively, during time analysis, the playback system 1 may do no more than evaluate normalized correlation between two distinct channels of the multichannel signal Si for a selection only of predetermined channel pairs of the signal Si.

For example, for a multichannel signal of 5.1 format, made up of a center at 0°, of left and right channels L and R situated at ±30° relative to the center, and of rear left and rear right channels Ls and Rs situated at ±110° C. relative to the center, this selection may comprise only four pairs of channels, namely the pair constituted by the channels L and R, the pair constituted by the channels Ls and Rs, the pair constituted by the channels L and Ls, and the pair constituted by the channels R and Rs.

Each correlation $R_{x,y}$ as evaluated in this way is then compared with a predefined threshold written THR.

If the correlation is greater than the threshold THR, then the playback system 1 estimates that the signal Si (and thus a fortiori the signal S) contains a sound object that is localized.

In contrast, if the correlation is less than the threshold THR, then the playback system 1 estimates that the signal Si contains a sound object that is diffuse.

The value of the threshold THR is determined empirically: it is preferably selected to lie in the range 0.5 to 0.8.

It is thus possible to extract as many sound objects from the signal Si as there are pairs of channels that are examined, or in equivalent manner as there are correlations that are evaluated between the channels of the signal Si.

When a sound object is estimated as being localized by the playback system 1, it estimates the position of the sound object relative to the sound playback spatial window W (by definition, a diffuse object does not have a position that is precise or identifiable in three-dimensional space. It is therefore not necessary to estimate its position relative to the playback spatial window W).

To this end, the playback system 1 in this example estimates the playback spatial window W from the reference position Pref and from the physical locations of the loudspeakers of the playback device 2.

The spatial window W may be determined geometrically by the playback system 1 in terms of excursion angle relative to the axis Δ passing through the center of the playback device 2 and the reference position Pref, on the basis of knowledge about the position Pref and about the physical locations of the loudspeakers of the device 2 placed at its ends (i.e. 2-1 and 2-N). In the example shown in FIG. 2, the spatial window W is associated by the playback system 2 with an excursion angle of Ω/2 relative to the axis Δ.

The position Pref and the physical locations of the loudspeakers of the device may be configured beforehand in the non-volatile flash memory 7 of the playback system 1, e.g. during construction of the playback system 1 if it is incorporated in the device 2, or during a prior step of configuring the playback system 1.

In a variant, the window W may be estimated by the playback system 1 with the help of a technique that is similar or identical to that described in the document by E. Corteel entitled "Equalization in extended area using multichannel inversion and wave-field synthesis", Journal of the Audio Engineering Society, No. 54(12), December 2006, when the position Pref is an extended area.

Other techniques known to the person skilled in the art may naturally be used as variants to the two techniques described above. Furthermore, in yet another variant, the spatial window W may be predetermined, and may for example be stored in the non-volatile flash memory 7 of the playback system 1.

For each pair of distinct channels in the signal Si, the playback system 1 also evaluates the level (or energy) difference between those channels, e.g. expressed in decibels (dB), in accordance with the following equation:

$$10\log_{10}\frac{\sum_{p=p0}^{P}\|x\|^2(p)}{\sum_{p=p0}^{P}\|y\|^2(p)}$$

where x and y respectively designate two distinct channels of the multichannel signal Si, where ||x|| designates the norm of the signal x, and where P and p0 designate constants specifying the number of signal samples over which energy is evaluated.

The level differences obtained in this way enable the system to determine the direction of the localized object relative to the reference position.

In this example, this direction is evaluated in terms of excursion angle relative to the axis Δ.

For this purpose, the playback system 1 associates a predetermined level difference between two channels, e.g. −30 dB (or respectively 30 dB), with the sound object being at a direction of 90° (or respectively −90°) relative to the axis Δ. Directions lying in the range −90° to 90° are then estimated on the basis of an increasing interpolation function (e.g. an increasing linear function) defined between the two values −90° and 90°.

Thereafter, the playback system 1 compares the direction of the sound object as evaluated in this way relative to the excursion angle Ω/2 defining the spatial window W in order to determine whether the object lies inside or outside the spatial window W: thus, a sound object for which a direction has been estimated as having an absolute value of more than Ω/2 relative to the axis Δ is considered by the system 1 as lying outside the spatial window W, whereas a sound object for which a direction has been estimated as having an absolute value that is less than or equal to Ω/2 relative to the axis Δ is considered by the system 1 as being positioned inside the spatial window W.

In the presently-described implementation, the playback system 1 also makes use of the estimated direction of the sound object to determine whether the object lies in the center of the spatial window W (to within an accuracy delta), in order to distinguish better during playback between objects situated in the center of the window W and other objects situated within the window W (step E40).

Thus, the playback system 1 considers that an object is positioned at the center of the spatial window W if its direction lies within a range [0, δ] about the axis Δ, where δ designates a predefined angle, e.g. 2.5°.

Nevertheless, this step is optional.

Alternative techniques may be used as variants during steps E30 and E40 in order to extract sound objects from the signals Si and estimate their characteristics (diffuse or localized nature, direction and position relative to the window W, and where appropriate amplitude).

Thus, in a second variant, the spatial analysis phase ΣI comprises determining a Gerzon vector representative of each multichannel audio signal Si (a vector is estimated for each frequency sub-band BWi).

As is known to the person skilled in the art, the Gerzon vector of a multichannel audio signal is derived from the respective contributions (direction and intensity or energy) of the various channels of the multichannel signal to the sound scene perceived by the listener situated at the reference position Pref. Document US 2007/0269063 describes how to determine such a vector for a multichannel audio signal (or in equivalent manner how to determine a normalized Gerzon vector), and this is not described in greater detail herein. It is assumed in this description that the playback system 1 in the second variant proceeds in a manner identical to that described in that document.

The Gerzon vector of a multichannel audio signal represents the spatial location of the multichannel audio signal as perceived by the listener at the reference position. By determining this Gerzon vector, it is possible to avoid calculating correlations between the various channels of the multichannel signal in order to determine the diffuse or localized nature of the sound object extracted from the signal, and in order to determine the positions of these objects relative to the spatial window W.

As described in Document US 2007/0269063, the Gerzon vector associated with a multichannel signal Si is written in the form of a directional vector giving the direction of the sound object associated with the frequency sub-band BWi, and a non-directional vector (i.e. a diffuse vector).

In other words, using the Gerzon vectors associated with the signals Si, the sound playback system 1 is capable of extracting the localized and diffuse sound objects making up the signal S and of determining the positions of the localized objects relative to the spatial window W (using the directions of the Gerzon vectors, and in particular its "directional" vectors), and it is also capable of extracting their amplitudes (determined from the norms of the Gerzon vectors and from the contributions of the directional/non-directional vectors).

This is done in a manner similar to that described for the time analysis of the signals Si, by comparing the norms of the vectors with one or more predefined thresholds, and by comparing their directions with the excursion angle Ω/2.

More precisely, for each normalized Gerzon vector, the norm of the directional vector and the norm of the non-directional vector are compared with a low threshold written THR_inf, and a high threshold, written THR_sup:

if the norms of the directional and non-directional vectors of the normalized Gerzon vector both lie between THR_inf and THR_sup, then both sound objects (i.e. the localized object corresponding to the directional vector and the diffuse object corresponding to the non-directional vector) are extracted and played back; else if one of the vectors has a norm greater than THR_sup, then only the object corresponding to that vector is extracted and played back (i.e. only a localized object or a totally diffuse object is played back).

The thresholds THR_inf and THR_sup are selected empirically, as a function of a compromise between complexity and the perception desired for the listener. For example, THR_inf=0.3 and THR_sup=0.7 for normalized amplitudes.

The amplitude associated with each sound object as extracted in this way is then derived from the amplitude of the corresponding directional or non-directional vector.

Alternatively, the diffuse and localized objects given by the non-directional vector and by the directional vector derived from the Gerzon vector are both extracted (no prior comparison relative to a threshold in order to estimate whether one and/or the other of them is providing a contribution that is sufficiently significant to be played back) in order to be played back on the loudspeakers of the playback device 2.

The directions of the directional vectors corresponding to the extracted sound objects are then compared with the excursion angle Ω/2 in order to determine their positions relative to the window W.

Furthermore, in a manner similar to the time analysis, the playback system 1 can identify objects that are situated at the center of the spatial window W, so as to distinguish them better during playback than other objects that are located inside the spatial window W.

It should be observed that the analysis techniques based on determining Gerzon vectors do not make it possible to extract more than one localized sound object per frequency sub-band.

In order to remedy that limitation, in a third variant of the invention, the spatial analysis means 3 of the playback system 1 extract the sound objects from the signals Si and estimate their characteristics during the steps E30 and E40 by performing a technique relying on a spatial decomposition of each multichannel signal Si into spherical harmonics.

In known manner, for each frequency band, the sound field p(r,ω) derived from each multichannel signal Si may be decomposed using spherical harmonic formalism as follows:

$$p(r,\omega)=\sum_{n=0}^{+\infty} i^n j_n(kr)\sum_{m=-n}^{n} B_{mn}(\omega)Y_{mn}(\varphi,\theta),$$

where:

$Y_{mn}(\phi,\theta)$ designates the spherical harmonic of degree m and of order n as defined by:

$$Y_{mn}(\varphi,\theta)=\sqrt{(2n+1)\varepsilon_n\frac{(n-m)!}{(n+m)!}}\,P_{mn}(\sin\theta)\times\begin{cases}\cos(m\varphi) & \text{if } m\geq 0\\ \sin(-m\varphi) & \text{if } m<0\end{cases},.$$

$B_{mn}(\omega)$ designates the coefficient (at the frequency ω) associated with the spherical harmonic $Y_{mn}(\phi,\theta)$ in the decomposition, and:

$i^2=-1$ k is a constant, $$\varepsilon_n=\begin{cases}1 & \text{if } n=0\\ 2 & \text{else}\end{cases}$$

$j_n(kr)$ is a spherical Bessel function of the first kind of order n, $P_{mn}(\sin\theta)$ is the associated Legendre function defined by:

$$P_{mn}(\sin\theta)=\frac{d^m P_n(\sin\theta)}{d^m(\sin\theta)^m}$$

where $P_n(\sin\theta)$ designates the Legendre polynomial of the first kind of order n.

In the particular circumstance of a plane wave of magnitude $O_{pw}$ coming from a direction $(\phi_{pw},\theta_{pw})$, the coefficients $B_{mn}(\omega)$ of the decomposition into spherical harmonics are given by:

$$B_{mn}(\omega)=\frac{O_{pw}}{4\pi}$$

and they are independent of frequency.

Thus, by way of example and in this third variant, the spatial analysis means 3 apply the technique of extracting sound objects from a multichannel signal by using its spatial decomposition into spherical harmonics as described in Document WO 2012/025580.

That technique relies on a representation of the matrix B(ω,t) constructed from the coefficients $B_{mn}(\omega)$ of the decomposition into spherical harmonics to which a short time Fourier transform (STFT) has been applied at the instant t, in the form of a sum of two terms, i.e. a first term modeling the localized sound objects contained in the signal Si, and a second term modeling the diffuse sound objects.

The directions of the localized sound objects are obtained from a correlation matrix:

$$S_{BB}(\omega,t)=E\{B(\omega,t)B^H(\omega,t)\}$$

Once the localized sound objects have been extracted, their contribution is removed from the signal Si in order to obtain the diffuse sound objects, if any, contained in the signal. As in the second variant based on representing the signal as a Gerzon vector, low and high thresholds may be introduced in order to extract only sound objects that are of sufficient amplitude.

The amplitudes associated with the localized sound objects are determined from the sums of the spherical harmonic coefficients associated with those objects as a function of the estimated directions. The amplitudes of the diffuse objects are estimated from the coefficients of the residual spherical harmonics obtained after removing the contribution of the localized sound objects.

Since this technique is described in detail in Document WO 2012/025580, it is not described in greater detail herein.

In order to determine the positions of the localized sound objects relative to the spatial window W, the playback system 1 proceeds in a manner similar to that described in the first variant for time analysis of the signals Si, by comparing their directions relative to the excursion angle Ω/2.

Furthermore, in similar manner to the time analysis, the playback system 1 can identify objects situated at the center of the spatial window W, so as to distinguish them better during playback relative to the other objects that are located inside the spatial window W.

It should be observed that in the presently-described implementation (and regardless of the technique used for spatial analysis), the playback system 1 does not, properly speaking, take into consideration the positions of the sound object extracted from the signals Si relative to the playback device 2, i.e. it does not distinguish between sound objects on the basis of whether they are situated behind or in front of the playback device 2 relative to the reference position Pref. Alternatively, the spatial analysis performed by the playback system 1 could be limited to sound objects situated behind the playback device 2, regardless of the spatial analysis technique used from among those described above.

Furthermore, in the presently-described implementation, the multichannel signal Si is decomposed into frequency sub-bands, and then the playback system 1 examines each frequency sub-band in order to extract the sound objects of the multichannel signal S. This makes it possible to extract more accurately the sound objects that make up the signal S (in particular it is possible to identify more sound objects). Nevertheless, this assumption is not limiting and it is possible in the context of the invention to envisage working directly on the multichannel signal S without performing decomposition into frequency sub-bands.

At the end of the spatial analysis ΣI, the playback system 1 has extracted and identified several categories of sound objects from the multichannel signal S, namely:

a first category of sound objects, written OBJLocIntW, comprising sound objects that are localized and situated inside the spatial window W;

a second category of sound objects, written OBJLocExtW, comprising sound objects that are localized and situated outside the spatial window W; and a third category of sound objects, written OBJDiff, comprising sound objects that are diffuse.

For the first and second categories of sound objects, the playback system 1 also has available the positions of these objects in the spatial window W.

In the presently-described implementation, the playback system 1 has also identified within the OBJLocIntW category of sound objects, those sound objects that come from sources positioned at the center of the spatial window W.

All of this information may be stored by way of example in the RAM 6 or in the non-volatile flash memory 7 of the playback system 1 in order to be used in real time.

As mentioned above, in accordance with the invention and in a "playback" second phase ΣII of playing back the multichannel audio signal S, the system 1 plays back the sound objects extracted from the signal S as a function of their categories, and as a function of the characteristics of these objects as determined during the steps E30 and E40.

More precisely, in the presently-described implementation, the playback means 4 of the playback system 1 apply four distinct treatments T-A1, T-A2, T-B, and T-C that are selected as a function of the characteristics of the sound objects extracted by the spatial analysis means 3 of the playback system 1 during the phase ΣI (step E50).

Thus, in the presently-described implementation, the sound objects identified as belonging to the first category OBJLocIntW are played back by the playback means 4 (and more precisely by the means 4A) by applying the treatments T-A1 or T-A2 depending respectively on whether or not they are situated at the center of the spatial window W (step E51).

In accordance with the invention, the treatments T-A1 and T-A2 play back the sound objects of the category OBJLocIntW inside the spatial window W.

Various types of treatments T-A1 and T-A2 may be envisaged for such playback. These treatments optionally implement filtering of the sound objects before diffusing them over some or all of the loudspeakers of the playback device 2.

Thus, for example, when the playback device 2 comprises a central loudspeaker and lateral loudspeakers:

the treatment T-A1 may be suitable for diffusing sound objects extracted from the signal S that are identified as being at the center of the spatial window W, directly over the central loudspeaker of the device 2; and the playback treatment T-A2 may be suitable for diffusing the sound objects extracted from the signal S and positioned in positions other than the center of the spatial window W over all of the loudspeakers of the playback device 2 and while using an intensity panning effect, selected so as to preserve the positions of the sound objects as perceived by the listener at the reference position.

In a variant, the playback treatments T-A1 and/or T-A2 as applied to the sound objects located inside the spatial window W may be more complex spatial filtering treatments, e.g. involving creating virtual sources 10 from the loudspeakers of the playback device 2 inside the spatial window W, the virtual sources being positioned in agreement with the characteristics of the sound objects as estimated during the steps E30 and/or E40 (i.e. in the directions and, where applicable, at the amplitudes as estimated in the steps E30 and E40).

Creating virtual sources by using loudspeakers of a playback device is known to the person skilled in the art and is not described herein. Playback treatment including the creation of virtual sources at the positions identified during the steps E30 and/or E40 may for example comprise wave field synthesis (WFS) treatment or beamforming, with the beam being directed for example towards the reference position.

The sound objects belonging respectively to the categories OBJLocExtW and OBJDiff are played back outside the spatial window W by the playback means 4 (respectively by the means 4-B and 4-C), while applying the treatments T-B and T-C (steps E52 and E53).

More precisely, in accordance with the invention, the playback treatments T-B and T-C comprise creating at least one virtual source 11, 12 outside the playback spatial window W of the playback device 2.

For sound objects of the category OBJLocExtW (step E52), these virtual sources 11 are reconstituted from the positions of sound objects as identified in step E30, e.g. by using a transaural technique (which is particularly well suited for a configuration of the playback device 2 having a central loudspeaker and two lateral loudspeakers), a WFS technique or a derivative thereof, e.g. as described in unpublished European patent application EP 1 116 572.0, or indeed forming a beam directed out from the playback spatial window and of width that can be configured so as to optimize sound rendering.

For sound objects of the category OBJDiff (step E53), the treatment T-C serves to create diffuse virtual sources 12. For this purpose, it is preferable to use beamforming techniques T-C for creating these virtual sources, for which it is easy to control the orientation and the width of the beams so as to create reflections on the walls of the room in which the playback device 2 is located, thereby further creating a surround-sound sensation for the listener placed at the reference position.

For a better understanding of the invention, three implementations are described below serving in particular to illustrate various spatial analysis techniques and various playback treatments that can be envisaged for the various steps of FIG. 5.

Example 1

In this first example, it is assumed that the playback device 2 is an acoustic enclosure of the horizontal soundbar type having three loudspeakers 2-1, 2-2, and 2-3 (a central loudspeaker and two lateral loudspeakers).

The position Pref is selected to be a point, centered relative to the playback device 2.

It is also assumed that the multichannel signal S delivered to the playback system 1 during the step E10 is a stereo audio signal, in other words is a signal made up of two distinct channels.

In this first example, the following steps are performed by the playback system 1 on the signal S:

1) Decomposing the signal S into frequency sub-bands in step E30 with the help of a Fourier transform applied to the signal S, each frequency sub-band comprising a signal Si that is itself made up of two channels.

2) Spatially analyzing ΣI the signal S, or in equivalent manner each signal Si in each frequency sub-band, by performing time analysis of the signal Si during step E30 in order to extract a sound object from the signal Si, this time analysis including in particular:

evaluating the normalized correlation between the two channels of the signal Si and comparing the correlation with the predefined threshold THR in order to estimate the localized or diffuse nature of the sound object included in the signal Si;

evaluating the difference in level between the two channels of the signal Si, and transforming this difference in level into an excursion angle relative to the axis Δ connecting the position Pref to the center of the playback device 2. In this first example, it is assumed that a difference level of −30 dB (or else +30 dB) corresponds to an excursion angle of 90° (or respectively of −90°), with intermediate values being estimated with the help of a linear function between these two limits;

estimating the sound playback spatial window W (and the excursion angle associated with the window) as defined by the reference position Pref and the lateral loudspeakers of the playback device 2. By way of illustration, if consideration is given to a reference position Pref situated at a distance lying in the range 2 meters (m) to 4 m from the playback device 2 and a playback device having a width of 1 m, with the lateral loudspeakers of the device being placed at its ends, then the excursion angle Ω/2 corresponding to the spatial window W lies in the range 7° to 15°; and from the excursion angle obtained for the sound object extracted from the signal Si and the excursive angle Ω/2 corresponding to the spatial window W, determining the direction of the sound object and its position relative to the window W. Thus, if the sound object extracted from Si presents an excursion angle that is less than or equal to Ω/2, it is estimated as being positioned inside the spatial window W. Conversely, if the sound object extracted from Si presents an excursion angle greater than Ω/2, it is estimated as being positioned outside the spatial window W.

The amplitude of each extracted sound object over each frequency sub-band is given by the level of the signal Si in that sub-band.

Spatially analyzing the signal S in the presently-described first example also comprises identifying (E40) sound objects located at the center of the spatial window W by comparing the excursion angle associated with each sound object extracted from the signals Si with the range [0, 2.5°], so that a sound object is considered as being at the center of the window if its excursion angle lies in the range 0° to 2.5° (in absolute value).

3) Playing back (ΣII/E50) the signal S, and more precisely the sound objects extracted during spatial analysis ΣI:

during the step E51, playing back inside the spatial window W localized sound objects that are estimated as being positioned inside the spatial window W (category OBJLocIntW), while using the following playback treatments T-A1 and T-A2:

treatment T-A1 applied to sound objects that are estimated as being at the center of the spatial window W: diffusing sound objects directly (i.e. without spatial filtering) from the central loudspeaker of the playback device 2, in other words the sound objects that are played back in this way are attached to the center of the playback device 2; and treatment T-A2 applied to the non-centered sound objects that are located inside the spatial window W: diffusing sound objects via the three loudspeakers of the playback device 2 while using an intensity panning effect;

during step E52, playing back outside the spatial window W localized sound objects that are estimated as being positioned outside the spatial window W (category OBJLocExtW), with the help of a transaural playback technique T-B. More precisely, two lateral loudspeakers of the playback device 2 are used to create transaural virtual sources located outside the window W, e.g. at 30° and 60° (or respectively at −30° and −60°) relative to the axis Δ. The sound objects of the category OBJLocExtW are then diffused through these virtual sources in the directions determined in step E30; and during step E53, playing back outside the spatial window W, sound objects that are diffuse (category OBJDiff), using a transaural playback technique T-C. More precisely, the two lateral loudspeakers of the playback device 2 are used to create transaural virtual sources located outside the window W at an angle greater than 60° (or respectively less than −60°) relative to the axis Δ. Sound objects of the category OBJDiff are then diffused through these virtual sources.

Transaural playback techniques are known to the person skilled in the art, and by way of example they are described in the document by J. Bauck and D. H. Cooper entitled "Generalized transaural stereo and applications", Journal Audio Engineering Society, Vol. 44, No. 9, 1996. Such techniques consist in applying a filter to each of the lateral loudspeakers of the playback device 2, each filter comprising a spatialization filter and a filter for canceling cross-propagation between two loudspeakers.

Example 2

In this second example, it is assumed that the playback device 2 is a compact acoustic enclosure of the horizontal soundbar type having 15 loudspeakers 2-1, 2-2, . . . , 2-15 and having a length of about 1 m.

The position Pref is selected to be a point that is centered relative to the playback device 2.

It is also assumed that the multichannel signal S delivered to the playback system 1 during step E10 is a 5.1 audio signal. Such a signal already contains spatialization information intrinsically. More specifically, the ITU-R BS.775-1 standard defining the format of 5.1 signals assumes a center situated at 0°, left and right channels L and R situated at ±30° relative to the center, and rear left and rear right channels Ls and Rs situated at ±110° relative to the center.

In this second example, the following steps are performed by the playback system 1 on the basis of the signal S:

1) Decomposing the signal S into frequency sub-bands in step E20 using a Fourier transform applied to the signal S, each frequency sub-band comprising a signal Si made up of five channels.

2) Spatial analysis ΣI of the signal S, or in equivalent manner each signal Si on each frequency sub-band, comprising in step E30 determining a Gerzon vector associated with each signal Si, in a manner similar to that described in Document US 2007/269063.

The sound objects situated at the center of the spatial window W are present in the central channel by definition of the 5.1 format. They are thus easily "extracted" from this central channel which is already isolated.

The playback system 1 then considers the signal Si' made up of four channels L, R, Ls, and Rs of the signal Si, and the four "channel" vectors associating the reference position Pref with the four channels L, R, Ls, and Rs. It gives each channel vector a weight corresponding to the energy of the associated channel. The Gerzon vector associated with the signal Si' (or in equivalent manner with the signal Si) is defined as the barycenter (i.e. center of gravity) of the points L, R, Ls, and Rs as weighted in this way.

The Gerzon vector as defined in this way is written in the form of a directional vector (equal to the sum of the two channel vectors adjacent to the Gerzon vector: thus, by way of example, if the direction of the Gerzon vector is 15° relative to the axis Δ, then the directional vector is the sum of the channel vectors associated respectively with the channels L and R), and in the form of a non-directional vector.

The directional vector characterizes a localized sound object of the signal Si and its position (given by the directional vector) relative to the window W. The playback system 1 compares this position with the excursion angle Ω/2 in a manner similar to Example 1, in order to estimate whether the sound object as identified in this way belongs to the category OBJLocIntW or to the category OBJLocExtW.

The non-directional vector characterizes a diffuse sound object of the signal Si, classified by the playback system 1 in the category OBJDiff.

The playback system 1 associates each extracted sound object with an amplitude that is evaluated from the amplitude of the corresponding vector (directional or non-directional and the component of the Gerzon vector).

3) Playing back ΣII/E50 the signal S, and more precisely the sound object extracted during the spatial analysis ΣI, using the directions and the amplitudes as estimated in step E30:

during the step E51, playing back within the spatial window W, the localized sound objects that are estimated as being positioned inside the spatial window W (category OBJLocIntW) with the help of the following playback treatments T-A1 and T-A2:

- treatment T-A1 applied to the sound objects that are estimated as being at the center of the spatial window W (i.e. objects contained in the central channel of the signal S): diffusing the sound objects directly (i.e. without spatial filtering) via the central loudspeaker of the playback device 2, in other words the sound objects as treated in this way are attached to the center of the playback device 2; and
- treatment T-A2 applied to the non-centered sound objects located inside the spatial window W: diffusing sound objects with the help of a wave field synthesis (WSF) technique by creating virtual sources via the loudspeakers of the playback device 2, these virtual sources being positioned (by acting on the delays and the gains applied to each loudspeaker) in the directions as estimated by the directional vectors extracted from the Gerzon vectors that were derived during the spatial analysis so as to comply with the same spatial organization as applied during the mixing of the multichannel signal. The amplitudes of the played-back sound objects comply with the amplitudes evaluated in step E30;

during the step E52, playing back outside the spatial window W localized sound objects that are estimated as being positioned outside the spatial window W (category OBJLocExtW) using a WFS technique comprising the creation of six virtual sources surrounding the reference position Pref:

- two virtual sources are positioned at the ends of the playback device 2; and
- four virtual sources are positioned outside the spatial window W, including: two virtual sources that are positioned respectively in the range 30° to 60° and in the range −30° to −60° relative to the axis Δ, e.g. with the help of two place waves directed towards the side walls of the room in which the playback device 2 is placed; and two virtual sources that are positioned respectively in the range 135° to 150° and in the range −135° and −150°, e.g. with the help of two place waves directed towards the rear walls of the room in which the playback device 2 is placed.

The virtual sources as positioned in this way are used for playing back the sound objects of the category OBJLocExtW along the directions and with the amplitudes estimated in step E30;

during the step E53, playing back outside the spatial window W diffuse sound objects (category OBJDiff) with the help of a WFS playback technique T-C, comprising creating four virtual sources outside the window W, e.g. with the help of four plane waves directed towards the walls of the room in which the playback device 2 is placed so as to reflect two reflections on the side walls situated in the range 60° to 80° (or respectively −60° to −80°) relative to the axis Δ.

Wave field synthesis techniques are known to the person skilled in the art, e.g. as described in the document by A. J. Berkhout et al. entitled "A holographic approach to acoustic control", J. Audio. Eng. Soc., Vol. 36, 1988. Such techniques consist in applying gain and a delay to each loudspeaker of the playback device 2. They rely solely on the relative positions of the virtual sources that it is desired to create (i.e. point sources or plane waves) relative to the physical positions of the various loudspeakers of the playback device 2.

Example 3

In this third example, it is assumed that the playback device 2 is a compact acoustic enclosure having eight loudspeakers 2-1, 2-2, . . . , 2-8, and having a width of about 80 cm, with four front loudspeakers 2-1, . . . , 2-4, and two respective pairs of loudspeakers 2-5 & 2-6 and 2-7 & 2-8 situated on opposite sides of the device 2 (device similar to device 2" shown in FIG. 3B).

The position Pref is selected to be a point, centered relative to the playback device 2.

It is also assumed that the multichannel signal S delivers to the playback system 1 during the step E10 is an audio signal made up of four distinct channels.

In this third example, the following steps are performed by the playback system 1 on the signal S:

1) Decomposing the signal S into frequency sub-bands in step E20 using a Fourier transform applied to the signal S, each frequency sub-band comprising a signal Si made up of four channels.

2) Spatially analyzing ΣI the signal S, or in equivalent manner each signal Si over each frequency sub-band during the step E30 and comprising:

spatial decomposition into spherical harmonics;

from each signal Si, extracting diffuse and localized sound objects from each signal and determining their characteristics (directions and amplitudes) using the technique described in Document WO 2012/025580 (this step may optionally include coding the signal Si in an audio format of the HOA type, which is itself known); and separating localized sound objects detected during scanning into the categories OBJLocIntW and OBCLocExtW by comparing the examined directions in which the objects have been detected relative to the excursion angle Ω/2 associated with the spatial window W, as described above for Examples 1 and 2.

3) Playing back ΣII/E50 the signal S, and more precisely the sound objects extracted during the spatial analysis ΣI:

during the step E51, playing back inside the spatial window W localized sound objects that are estimated as being positioned inside the spatial window W (category OBJLocIntW) with the help of playback treatment T-A combining a WFS technique and radiation control that takes account of the radiation from each loudspeaker and the influence of the acoustic enclosure proper that contains the various loudspeakers. The sound playback field for each object is controlled by means of filters. Such treatment is described in particular in the not-yet published European patent application EP 1 116 572.0.

Thus, and more precisely, in this third example, the treatment T-A comprises creating virtual sources behind the playback device 2 by using the WSF technique, and applying filtering to the loudspeakers 2-1, . . . , 2-8 of the device 2 that is determined in such a manner that the energies of these sound objects played back via these virtual sources are directed towards the reference position and comply with the amplitudes determined in step E30;

during the step E52, playing back outside the spatial window W localized sound objects that are estimated as being positioned outside the spatial window W (category OBJLocExtW) with the help of playback treatment T-B as described in the not-yet published European patent application EP 11165720.1, and combining:

a WFS technique comprising creating virtual sources outside the spatial window W by forming two narrow beams that are reflected on the side walls of the room in which the playback device 2 is installed to a predetermined point position; and applying filtering to the loudspeakers 2-1, . . . , 2-8 of the device 2 that is determined in such a manner that the energies of the sound objects played back by the virtual sources are directed and concentrated on the side walls of the room.

The virtual sources as positioned in this way are used to play back the sound objects of the category OBJLocExtW along the directions and with the amplitudes estimated in step E30;

during step E53, playing back outside the spatial window W diffuse sound objects (category OBJDiff) with the help of playback treatment T-C as described in not-yet published European patent application EP 11165720.1, and combining:

a WFS technique comprising creating virtual sources outside the spatial window W by forming two wide beams that are reflected on a predetermined extended zone of the side walls of the room in which the playback device 2 is installed; and applying filtering to the loudspeakers 2-1, . . . , 2-8 of the determined device 2 in such a manner that the energies of the sound objects played back via these virtual sources are directed and concentrated on the side walls of the room.

Naturally, these three examples are given purely by way of illustration and other configurations for the playback device, and also other spatial analysis techniques and other playback treatments could be used within the ambit of the invention.

The invention claimed is:

1. A method of playing back a multichannel audio signal via a playback device having a plurality of loudspeakers, said loudspeakers being arranged at fixed locations of the playback device and defining a spatial window for playing back sound relative to a reference spatial position, said playback method comprising:

a spatial analysis step of spatially analyzing the multichannel audio signal, this step comprising:

extracting at least one sound object from the signal; and for each extracted sound object, estimating a diffuse or localized nature of this sound object, and estimating a position of this sound object relative to the sound playback spatial window of the playback device; and a playback step of playing back the audio signal via the plurality of loudspeakers of the playback device, during which step, playback treatment is applied to each sound object extracted from the audio signal for playing that object back via at least one loudspeaker of the plurality of loudspeakers of the playback device, this playback treatment depending on the diffuse or localized nature of the sound object and on its position relative to the sound playback spatial window as estimated during the spatial analysis step;

the playback treatment including using the loudspeakers of the playback device to create at least one virtual source outside the playback spatial window of the playback device whenever the sound object is estimated during the spatial analysis step as being diffuse or as being positioned outside the playback spatial window of the playback device.

2. A method according to claim 1, wherein the playback device is an acoustic enclosure having said plurality of loudspeakers arranged therein.

3. A method according to claim 1, wherein the spatial analysis step further comprises estimating the position of the sound object relative to the center of the sound playback spatial window of the playback device.

4. A method according to claim 1, wherein the spatial analysis step comprises decomposing the received audio signal into a plurality of frequency sub-bands, with said at least one sound object being extracted on at least one frequency sub-band.

5. A method according to claim 1, wherein the diffuse or localized nature of the extracted sound object is estimated from at least one correlation evaluated between two distinct channels of the multichannel audio signal.

6. A method according to claim 1, wherein the position of the extracted sound object relative to the sound playback spatial window is estimated from at least one difference of level as evaluated between two distinct channels of the multichannel audio channel.

7. A method according to claim 1, wherein the spatial analysis step comprises determining a Gerzon vector representative of the multichannel audio signal.

8. A method according to claim 1, wherein the spatial analysis step comprises spatially decomposing the multichannel signal into spherical harmonics.

9. A method according to claim 1, wherein when an extracted sound object is estimated as being localized and as being positioned inside the sound playback spatial window of the playback device, the playback treatment applied to the sound object during the playback step is suitable for playing back the sound object inside the sound playback spatial window of the playback device.

10. A method according to claim 9, wherein said playback treatment comprises creating at least one virtual source from the loudspeakers of the playback device inside the sound playback spatial window of the playback device.

11. A method according to claim 1, wherein when the extracted sound object is estimated during the spatial analysis step as being positioned outside the playback spatial window of the playback device, creating at least one virtual source outside the playback spatial window of the playback device comprises forming at least one beam that is directed to the outside of the playback spatial window.

12. A method according to claim 1, wherein:

the plurality of loudspeakers of the playback device comprises a central loudspeaker and lateral loudspeakers; and when the extracted sound object is estimated during the spatial analysis step as being diffuse or as being positioned outside the playback spatial window of the playback device, the playback treatment applied to the sound object uses a transaural technique for playing back the sound object via the lateral loudspeakers of the playback device.

13. A method according to claim 1, wherein when an extracted sound object is estimated during the spatial analysis step as being localized and positioned inside the playback spatial window of the playback device, the playback treatment applied to the sound object during the playback step comprises forming a beam that is directed towards said reference spatial position.

14. A method according to claim 1, wherein:

the plurality of loudspeakers of the playback device comprises a central loudspeaker and lateral loudspeakers; and when an extracted sound object is estimated during the spatial analysis step as being localized and as being positioned at the center of the playback spatial window of the playback device, the sound object is diffused during the playback step by playback treatment via the central loudspeaker of the playback device.

15. A method according to claim 1, wherein, when an extracted sound object is estimated during the spatial analysis step as being localized and positioned inside the playback spatial window of the playback device at a position that is distinct from the center of the window, the playback treatment applied during the playback step diffuses this sound object via the loudspeakers of the playback device while using an intensity panning effect.

16. A program embedded on a non-transitory computer readable medium including instructions for executing steps of the playback method according to claim 1 when said program is executed by a computer or by a microprocessor.

17. A system for playing back a multichannel audio signal via a playback device having a plurality of loudspeakers, said loudspeakers being arranged at fixed locations of the playback device and defining a spatial window for playing back sound relative to a reference position, said playback system comprising:

spatial analysis means for spatially analyzing the multichannel audio signal, these means comprising:

extraction means for extracting at least one sound object from the signal; and estimation means for estimating a diffuse or localized nature of this sound object, and estimating a position of this sound object relative to the sound playback spatial window of the playback device; and playback means for playing back the audio signal via the plurality of loudspeakers of the playback device, which means are suitable for applying playback treatment to each sound object extracted from the audio signal for playing that object back via at least one loudspeaker of the plurality of loudspeakers of the playback device, this playback treatment depending on the diffuse or localized nature of the sound object and on its position relative to the sound playback spatial window as estimated by the spatial analysis means;

the playback treatment including using the loudspeakers of the playback device to create at least one virtual source outside the playback spatial window of the playback device whenever the sound object is estimated by the spatial analysis means as being diffuse or as being positioned outside the playback spatial window of the playback device.

* * * * *